US011643899B1

(12) United States Patent
Ramasamy et al.

(10) Patent No.: US 11,643,899 B1
(45) Date of Patent: May 9, 2023

(54) DEVICE AND METHOD FOR LIGHT DISSOLVABLE ENCAPSULATION ACTIVATION FOR DOWNHOLE APPLICATIONS

(71) Applicant: SAUDI ARABIAN OIL COMPANY, Dhahran (SA)

(72) Inventors: Jothibasu Ramasamy, Dhahran (SA); Chinthaka Gooneratne, Dhahran (SA); Jianhui Xu, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/652,814

(22) Filed: Feb. 28, 2022

(51) Int. Cl.
*E21B 33/12* (2006.01)
*E21B 34/06* (2006.01)

(52) U.S. Cl.
CPC ..... *E21B 33/1208* (2013.01); *E21B 34/063* (2013.01)

(58) Field of Classification Search
CPC ..... E21B 33/1208; E21B 34/063
See application file for complete search history.

(56) References Cited

U.S. PATENT DOCUMENTS

| | | | | |
|---|---|---|---|---|
| 8,800,880 | B2 | 8/2014 | Christiansen | |
| 9,115,573 | B2 | 8/2015 | Purkis et al. | |
| 9,488,046 | B2 | 11/2016 | Purkis | |
| 9,989,665 | B2 | 6/2018 | Clark et al. | |
| 10,502,008 | B2 * | 12/2019 | Perrin | E21B 17/1078 |
| 10,502,046 | B2 * | 12/2019 | Mahjoub | E21B 17/1078 |
| 10,844,689 | B1 * | 11/2020 | Ramasamy | E21B 33/138 |
| 10,865,620 | B1 * | 12/2020 | Ramasamy | E21B 41/00 |
| 10,968,736 | B2 | 4/2021 | Batarseh | |
| 2003/0198374 | A1 | 10/2003 | Hagene et al. | |
| 2017/0159363 | A1 | 6/2017 | Lazarev et al. | |
| 2017/0191314 | A1 | 7/2017 | Faircloth et al. | |

FOREIGN PATENT DOCUMENTS

| | | | | |
|---|---|---|---|---|
| KR | 101416182 | B1 | 8/2014 | |
| WO | WO-2015188922 | A2 * | 12/2015 | C30B 29/04 |

* cited by examiner

*Primary Examiner* — Matthew R Buck
(74) *Attorney, Agent, or Firm* — Osha Bergman Watanabe & Burton LLP

(57) ABSTRACT

A downhole device that drills a wellbore includes a stabilizer which has a body and blades. The blades are disposed on a surface of the body and each blade has a hollow space. The blades each include a dissolvable window that is disposed on a surface of each of the blades and a light source that emits light to the wellbore. The dissolvable window blocks light emitted from the light source thereby reducing or eliminating light from being transmitted to the wellbore. The dissolvable window dissolves upon exposure to a fluid containing a dissolving medium, thereby allowing the light source to transmit light to the wellbore. Methods of using the downhole device to activate downhole chemicals are also provided.

12 Claims, 4 Drawing Sheets

DEVICE AND METHOD FOR LIGHT DISSOLVABLE ENCAPSULATION ACTIVATION FOR DOWNHOLE APPLICATIONS

BACKGROUND

Wells are drilled into subsurface formations to produce valuable resources, such as oil and gas. A well is typically drilled by a downhole device to form a wellbore. A downhole device is inaccessible from a surface when lowered into a well and a downhole environment. It can be difficult to treat downhole issues such as lost circulation, shale stability, stuck pipe, and friction reduction that are caused downhole during drilling.

In order to deal with the aforementioned downhole issues, chemical treatments that respond to external stimuli (e.g., pH, temperature, pressure, light, electric field, and magnetic field) and drilling tools may be used. However, such external stimuli and drilling tools are not within the control of a downhole device from the surface. Therefore, development of new tools or modification of existing tools are needed to support chemical treatments in the downhole environment.

SUMMARY

This Summary is provided to introduce a selection of concepts that are further described in the Detailed Description. This Summary is not intended to identify key or essential features of the claimed subject matter, nor is it intended to be used as an aid in limiting the scope of the claimed subject matter.

In one aspect, embodiments disclosed herein relate to a downhole device that drills a wellbore including a stabilizer. The stabilizer may include a body and blades that are disposed on a surface of the body, and each blade may have a hollow space. The blades may further include a dissolvable window disposed on a surface of each of the blades and a light source that is configured to emit light to the wellbore. The dissolvable window may block light emitted from the light source thereby reducing or eliminating light from being transmitted to the wellbore. Furthermore, the dissolvable window may dissolve upon exposure to a fluid containing a dissolving medium, thereby allowing the light source to transmit light to the wellbore.

In another aspect, embodiments disclosed herein relate to a method for activating downhole chemicals, wherein the method may include providing a stabilizer that includes a body and blades disposed on a surface of the body, and each blade has a hollow space. Furthermore, the blades each include a dissolvable window disposed on a surface of each of the blades, and a light source that is configured to emit light to the wellbore. The method may further include introducing a fluid containing a dissolving medium and photosensitive capsules into the wellbore such that the dissolving medium contacts the dissolvable window, dissolving the dissolvable window thereby exposing the wellbore to the light source, exposing photosensitive capsules to light emitted from the light source, and degrading the photosensitive capsules by irradiation of the light.

Other aspects and advantages of the claimed subject matter will be apparent from the following description and the appended claims.

DETAILED DESCRIPTION

Figure 1:
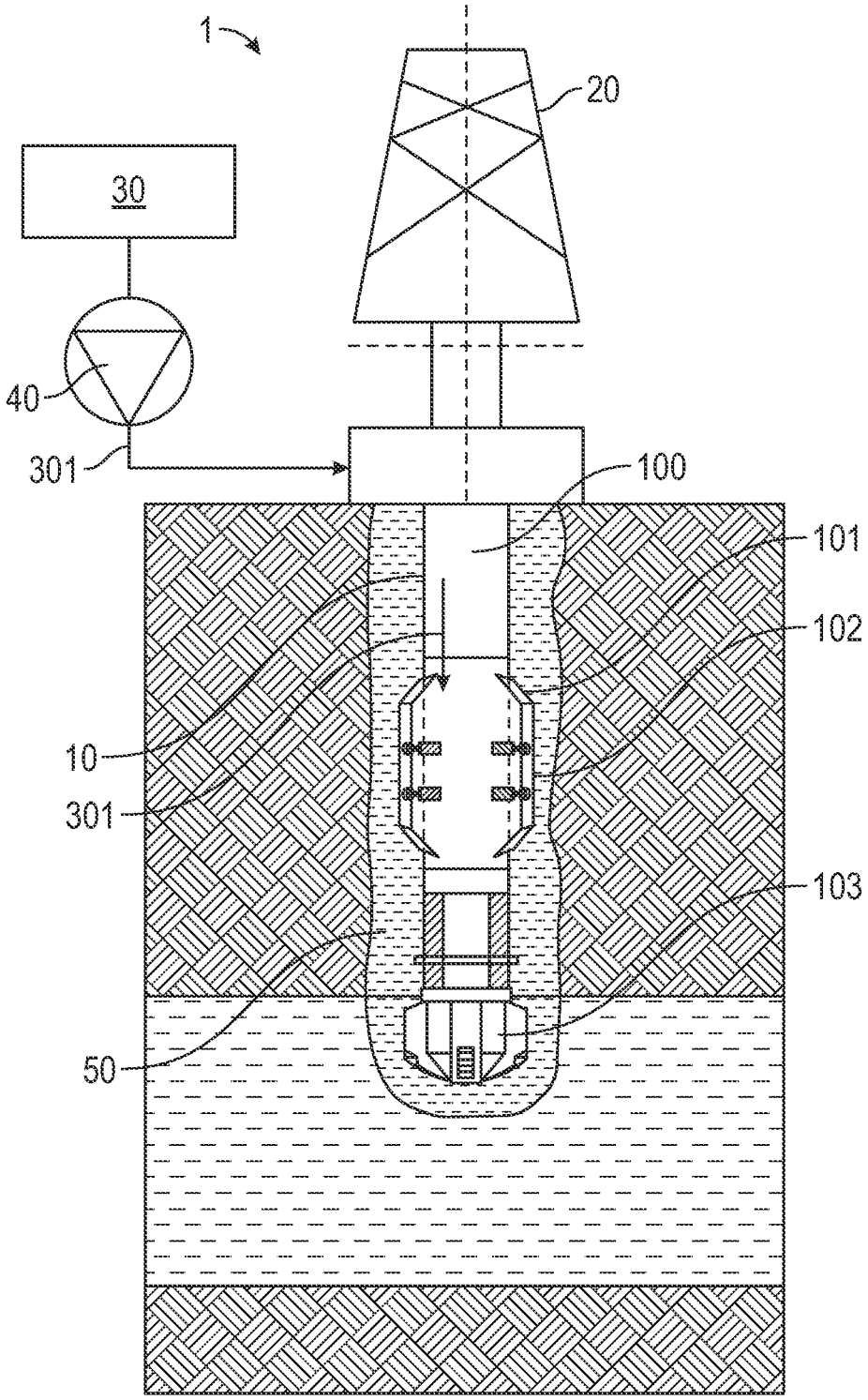
FIG. 1 is a schematic diagram of a system with a downhole device in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

"Uphole" may refer to objects, units, or processes that are positioned closer to the surface entry in a wellbore. "Downhole" may refer to objects, units, or processes that are positioned farther from the surface entry in a wellbore.

Embodiments disclosed herein generally relate to downhole devices and methods that activate downhole chemicals in accordance with one or more embodiments. In one or more embodiments, a fluid introduced into the wellbore contains a dissolving medium, at least one reactant, and photosensitive capsules that respond to light. Furthermore, the photosensitive capsules contain chemical substances useful for downhole applications such as super absorbent polymers or crosslinkers. Once the chemical substances inside the photosensitive capsules are released into the fluid by irradiation of light, the super absorbent polymers or crosslinkers undergo chemical reaction with the reactants in the fluid. The super absorbent polymers, crosslinkers and reactants in the fluid may be selected so that a variety of chemical reactions may be caused to address various downhole situations.

FIG. 1 illustrates a system 1 in accordance with one or more embodiments of the present disclosure. As shown in FIG. 1, a system 1 may include a downhole device 10, a rig 20, a fluid tank 30, and one or more pumps 40. The rig 20 is the machine used to drill a borehole to form a wellbore 50. The rig 20 may include drilling fluid tanks, drilling fluid pumps (e.g., rig mixing pumps), a derrick or mast, draw-works, a rotary table or top drive, drill string, power generation equipment and auxiliary equipment.

The downhole device 10 drills a borehole into the earth, such as drilling oil and natural gas wells. The borehole may be referred to as a downhole environment. The downhole device 10 may include a drill pipe 100, a stabilizer 101, and a drill bit 103 on a tip of the downhole device 10 to drill a borehole. The stabilizer 101 may include a blade 102 on a surface of the body of the stabilizer 101. The downhole device 10 may further contain a rig 20 disposed above the opening of the borehole.

A drilling fluid may be pumped down a wellbore 50 from the rig 20 that may contain tanks with drilling fluid. The drilling fluid may be referred to as drilling mud or simply mud. The mud may be an oil-based mud or a water-based mud. A fluid 301 containing chemicals and a dissolving medium may be pumped from a fluid tank 30 using pumps 40 and flows through the drill pipe 100 to the drill bit 103, flows out from the drill bit 103 and circulates back up in the wellbore 50.

The blade 102 is disposed on the surface of the body of the stabilizer 101 and stabilizes the downhole device 10 in the borehole.

In a drilling operation, the fluid 301 may be pumped from a drilling tank 30 using one or more pumps 40 to send the fluid 301 to the downhole device 10 flowing through the drill pipe 100 into the borehole. The flow rate of the fluid 301 may be adjusted by setting a pumping rate of the pumps 40 per standard drilling protocols. In accordance with one or more embodiments of the present disclosure, the fluid may include a dissolving medium, at least one reactant, and photosensitive capsules.

Figure 2B:
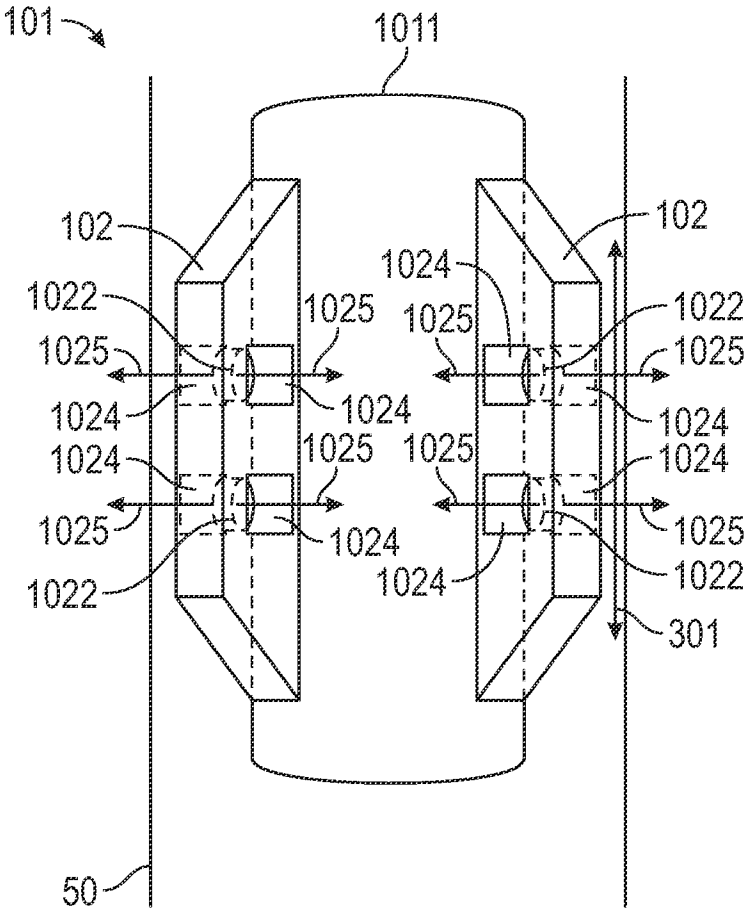
FIGS. 2A and 2B are schematic diagrams of a stabilizer including a body and blades that are disposed on a surface of the body in accordance with one or more embodiments.
Figure 2A:
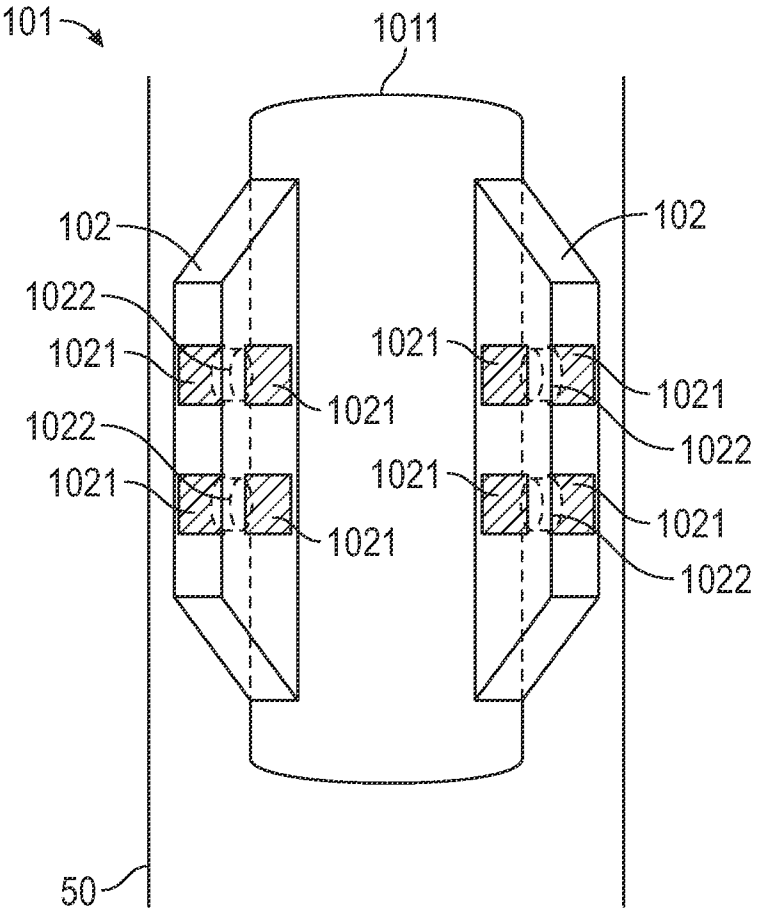

FIGS. 2A and 2B are schematic diagrams of a downhole device including a body 1011 of the stabilizer 101 and blades 102 disposed on a surface of the body 1011. Each of the blades 102 contain a dissolvable window 1021 and a light source 1022 in accordance with one or more embodiments. The dissolvable window 1021 and the light source 1022 may be disposed at the same height along the axial direction of the stabilizer 101. A blade 102 may be disposed on the surface of the body 1011 of the stabilizer 101. In the embodiments shown in FIGS. 2A and 2B, the blade 102 is straight and positioned parallel to the drill pipe. However, as may be appreciated by those skilled in the art, the position and shape of the blade may vary. For example, the blade may be straight and positioned diagonally along the body of the stabilizer. The angle of the diagonal of the blade as compared to the body may also vary. For example, the angle of the blade as compared to the body may be around 30°, 45° or 60°. Some blades may be curved rather than straight.

FIG. 2A shows a dissolvable window 1021 blocking the light emitted from the light source 1022 from being transmitted to the wellbore 50. FIG. 2B shows the light 1025 emitted from the light source 1022 being transmitted (as indicated by the horizontal arrows) via a dissolved window 1024 to the wellbore 50 when the dissolvable window 1021 is dissolved by a fluid 301 containing a dissolving medium. Such a fluid may be introduced into the drill pipe and circulates back up through the wellbore 50 towards the surface thereby contacting the dissolvable window as it travels uphole.

In one or more embodiments of the present disclosure, a blade 102 may include a dissolvable window 1021 and a light source 1022. The light source 1022 may emit light 1025 to the outside of the stabilizer and into the wellbore (FIGS. 2B and 3B).

Figure 3B:
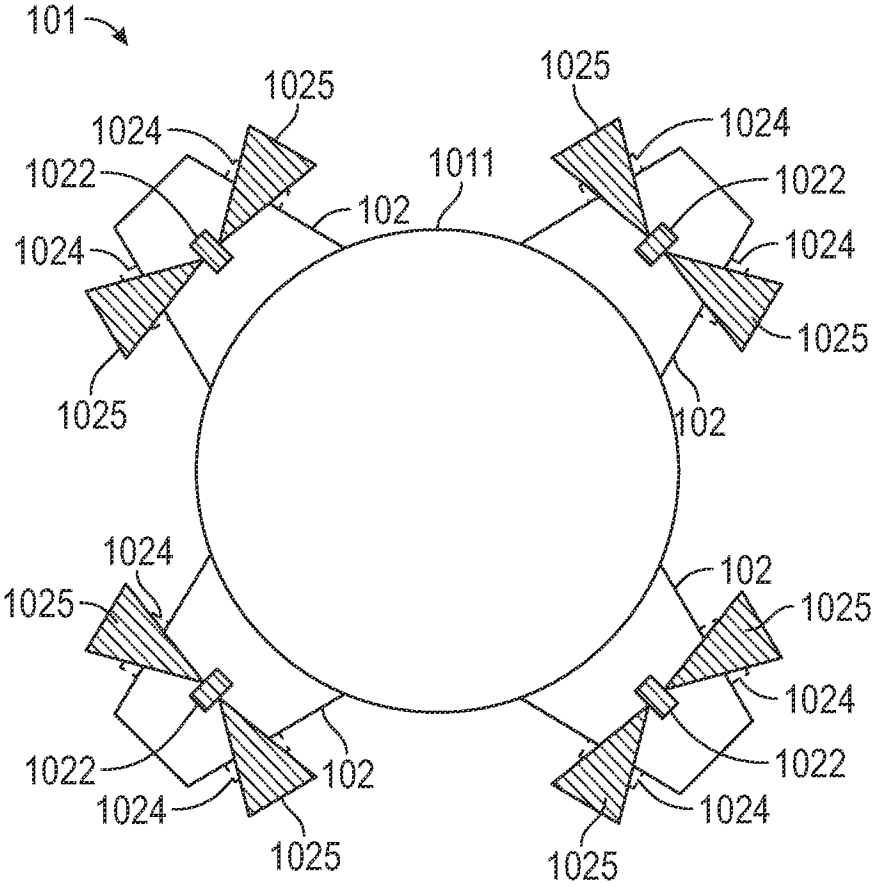
FIGS. 3A and 3B are top-down views of stabilizers, each stabilizer including a body and blades that are disposed on a surface of the body in accordance with one or more embodiments.
Figure 3A:
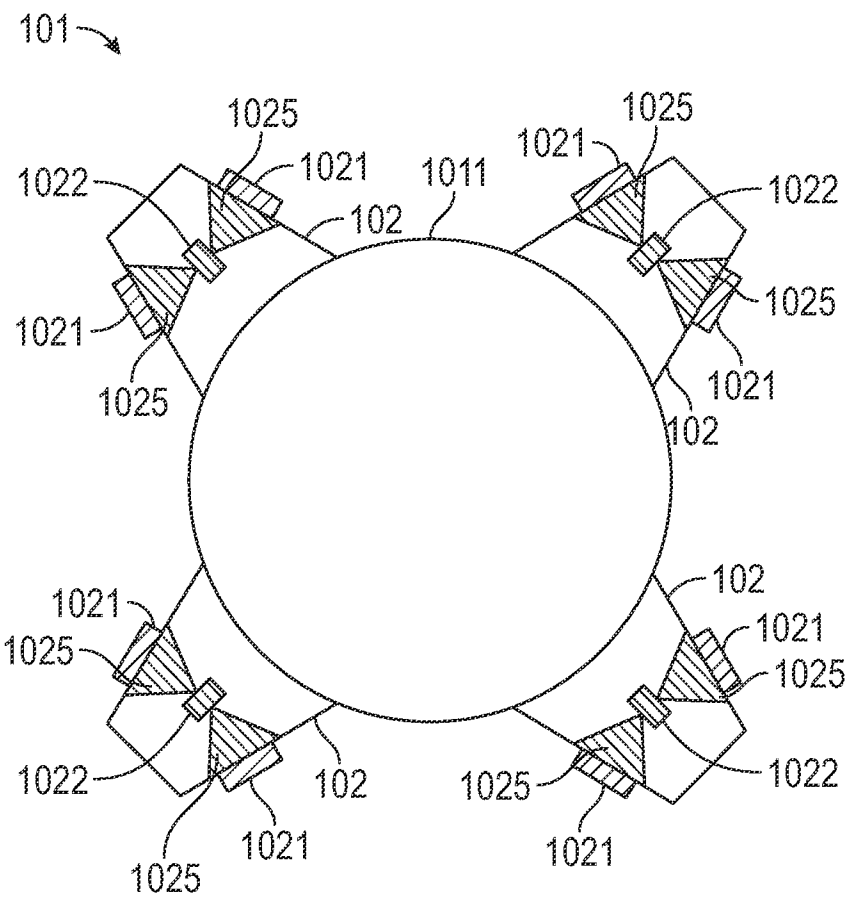

FIGS. 3A and 3B are top-down views of a stabilizer 101 including a body 1011 and blades 102 disposed on a surface of the body 1011. Each blades 102 contain a dissolvable window 1021 and a light source 1022 in accordance with one or more embodiments. As shown in FIG. 3A, the dissolvable window 1021 may be disposed on the surface of the blade 102 and the light source 1022 is disposed in the hollow space of the blade 102. As shown in FIG. 3B, when the dissolvable window 1021 is dissolved by contacting the fluid 301 flowing in the wellbore, the light 1025 emitted from the light source 1022 is transmitted via dissolved window 1024 to the wellbore.

As shown in FIG. 2A, the dissolvable window 1021 of one or more embodiments blocks the light emitted from the light source 1022 thereby reducing or eliminating light from being transmitted to the wellbore 50 at normal state. In the present disclosure, a "normal state" refers to a state with no dissolving medium introduced into the drill pipe. When a fluid 301 containing a dissolving medium is pumped through the drill pipe and flows out from drill bit 103 to the wellbore 50, the dissolvable window 1021 is in contact with the fluid 301 and is dissolved by the dissolving medium thereby causing the light source 1022 to transmit light 1025 to the wellbore 50 (FIGS. 2B and 3B).

In one or more embodiments of the present disclosure, the dissolvable window 1021 may be made of a dissolvable metal or a dissolvable polymer. The dissolvable metal may be magnesium-based alloy or aluminum-based alloy. The dissolvable metal may be a commercially available product, such as those available from Terves Inc. (Euclid, Ohio). For example, the TervAlloy™ product line from Terves Inc. may include a number of suitable materials to be used as the dissolvable metal. The dissolvable metal may be selected based on its mechanical properties and its dissolution rate in different solutions. The dissolvable polymer of the dissolvable window 1021 may be a dissolvable polymer such as polyglycolic acid (PGA) or polylactic acid (PLA). In one or more embodiments of the present disclosure, the dissolvable window 1021 including dissolvable metal or dissolvable polymer may have thickness of from about 1 mm to about 50 mm.

In one or more embodiments of the present disclosure, the dissolving medium contained in the fluid 301 may be selected from the group consisting of brine, acid, water, and combinations thereof. The brine and acid composition may be selected based on the composition of the dissolvable window. For example, the brine may be potassium chloride in a suitable concentration range, such as from about 0.1 wt. % (weight percent) to about 25 wt. % in the dissolving medium. The acid may be any suitable acid known to a person of ordinary skill in the art, and its selection may be determined by the specific dissolvable window being used. In some embodiments, the acid may be one or more selected from the group consisting of hydrochloric acid, sulfuric acid, carboxylic acids such as acetic acid, and hydrofluoric acid. The acid may be included in the dissolving medium in an amount ranging from about 0.1 wt % to about 25 wt. %.

In one or more embodiments of the present disclosure, when the temperature and pressure of the downhole environment are fixed, the dissolving rate of the dissolvable window 1021 can be selected by changing fluid composition of the fluid 301. The dissolving rate of the dissolvable window 1021 including dissolvable metal can be controlled by the concentration of brine or acid which are selected as dissolving mediums. When a brine having concentration in the range of 0.1% to 25% is used as a dissolving medium in conjunction with a dissolvable metal window, metal hydroxide powder is produced from a reaction between the dissolvable metal and the brine. The metal hydroxide powder may be flushed away by the dynamic flow of the fluid. In one or more embodiments, when an acid with a concentration in the range of 0.1% to 25% is used as a dissolving medium in conjunction with a dissolvable metal window, the product of a reaction between the dissolving medium and the acid may be ions that are soluble in the acid solution. As will be appreciated by those skilled in the art, as the wellbore is drilled deeper into the earth, the temperature and pressure within the wellbore may increase. Therefore, adjustments in the brine or acid concentration may be made to account for increased dissolution due to increased temperature and pressure.

In one or more embodiments, polymer-based dissolvable windows may be dissolved by water. The dissolving rate of the polymer-based window depends on the temperature and fluid composition. The dissolvable polymers may be degraded by hydrolysis, that is, degrading the dissolvable polymers into smaller polymers by exposing them to water such that chemical bonds are hydrolyzed resulting in the polymers losing their structural integrity and the mechanical properties.

In one or more embodiments, when a water-based mud is used as a drilling fluid, the polymer-based dissolvable window will begin to dissolve upon contact with the water of the water-based mud. Therefore, adjustments in the brine or acid concentration of the dissolving medium may be made to account for increased dissolution due to water of the water-based mud.

In one or more embodiments of the present disclosure, the light source 1022 disposed on the blade 102 may be an ultraviolet (UV) light source or a light emitting diode (LED). Furthermore, the light source 1022 may emit at least 2 different wavelengths of light. The wavelengths of the light source 1022 may be in a range of 10-800 nm depending on the photosensitive material used for encapsulation.

Figure 4:
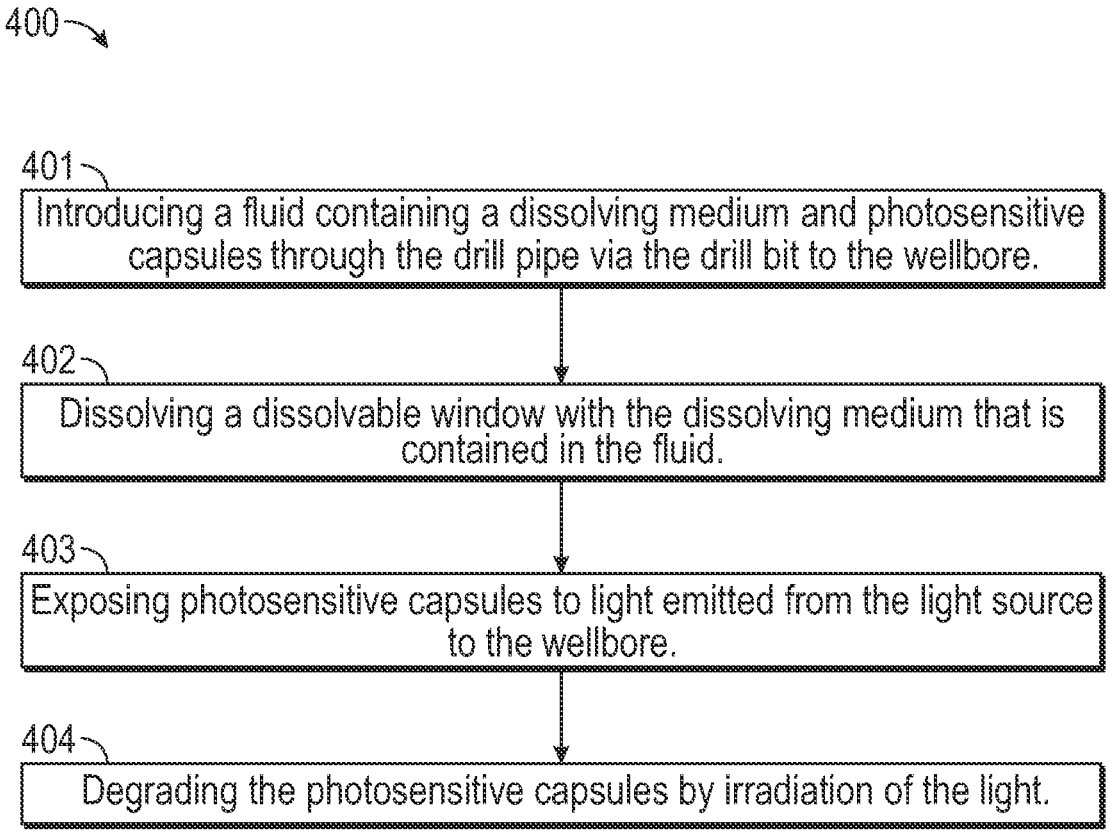
FIG. 4 is a flowchart of the method of activating downhole chemicals in accordance with one or more embodiments.

The present disclosure also relates to a method of activating downhole chemicals. FIG. 4 is a flowchart of a method 400 of activating downhole chemicals in accordance with one or more embodiments.

As shown in FIG. 4 and referring back to FIG. 1, at step 401, a fluid 301 containing a dissolving medium, at least one reactant, and photosensitive capsules is introduced from a fluid tank 30 located at the surface of the earth using one or more pumps 40. The fluid flows down through the hollow space of the drill pipe and the stabilizer 101 with a blade 102 disposed on the surface.

In one or more embodiments, the fluid, dissolving medium, and photosensitive capsules may be introduced simultaneously or the dissolving medium may be introduced first and then the photosensitive capsules may be introduced after the windows have dissolved.

The blade 102 includes a light source 1022 that emits light to the wellbore 50, and a dissolvable window 1021 disposed on the surface of the blade 102 between the light source 1022 and the wellbore 50. As the fluid 301 flows through the wellbore 50, the dissolving medium contained in the fluid 301 contacts the dissolvable window 1021 and dissolves the dissolvable window 1021 (step 402). The rate at which the window dissolves varies based on the composition of the dissolvable window 1021, the composition of the dissolving medium, and the temperature and pressure of the downhole environment. In one or more embodiments, about 100 mg per $cm^2$ of the surface area of the dissolvable window 1021 may be dissolved in about 1 hour. It may take from about 1 to 5 hours to break down the dissolvable window 1021.

The light 1025 emitted from the light source 1022 is transmitted through the empty space where the dissolved window 1024 was located to the wellbore 50. The photosensitive capsules in the fluid 301 are exposed to light 1025 emitted from the light source (step 403). The photosensitive capsules degrade by irradiation of light 1025 (step 404). Once the photosensitive capsules are degraded, chemicals such as super absorbent polymers, activators, crosslinkers, or triggers contained in the photosensitive capsules are released into the fluid.

In one or more embodiments, photosensitive capsules in the fluid 301 may be composed of photodegradable polymers. Photodegradable polymers may include photodegradable pendant groups, polymers that undergo chain scission reactions, polymers with photodegradable blocks, or polymers with photo-labile crosslinkers. In one or more embodiments, polymers that undergo chain scission reactions or polymers that undergo cleavage in cross-linkers are particularly useful for developing encapsulated capsules.

In one or more embodiments, photosensitive capsules in the fluid 301 may be polymers made of photo responsive monomers such as trans-azobenzene, cis-azobenzene, trans-stilbene, cis-stilbene, spiropyran or merocyanin. Polymers may be obtained by introducing such photo responsive monomers as photosensitive moieties in the polymeric backbone or in the sidechains.

In one or more embodiments, photosensitive capsules degrade by light-induced structural changes of the aforementioned monomers. The structural change of the photo responsive monomers may be cis-trans isomerization or ring-opening reaction. Isomerization may be accompanied by molecular changes in physical properties such as polarity, viscosity and absorbance. The change in such physical properties affect permeability of photosensitive capsules and leads to degradation of the shell of the capsules.

In one or more embodiments, the methods for encapsulation of super absorbent polymers, or crosslinkers inside photosensitive polymer capsules may include interfacial methods, templating methods, and self-assembly methods. Interfacial methods may be polycondensation or polyaddition of photo responsive monomers. Templating method may be layer-by-layer approach using polyelectrolytes or layer-by-layer approach using host-guest systems. Self-assembly is a spontaneous formation of non-covalent association of organic molecules in solution. Self-assembly method may be used to for micelles of block copolymers. Such techniques for encapsulation are understood by those skilled in the art and may be used as necessary to appropriately encapsulate the super absorbent polymers, or crosslinkers disclosed herein.

In one or more embodiments of the present disclosure, once the super absorbent polymers or crosslinkers are released from the capsules, they react with reactants in the fluid. Such reactants may include polymers, water, resins, or crosslinkers. For example, when sodium polyacrylate (a super absorbent polymer) is released from photosensitive capsules, it reacts with water in the fluid 301 and form a thick plug to cure loss of circulation.

In one or more embodiments, crosslinkers may be any material that initiates crosslinking of resins used in downhole applications. For example, the crosslinker may be used to crosslink resins used as loss circulation materials such that the resin hardens in particular locations to treat loss circulation.

In one or more embodiments, the crosslinker is an amine type curing agent. Amine type curing agents may include a low molecular weight compound having a primary-, secondary-or tertiary amino group, and combinations thereof. "Low molecular weight" compounds having a primary amino group include, but are not limited to, primary amines, such as ethylenediamine, diethylenetriamine (DETA), triethylenetetramine, tetraethylenepentamine, hexamethylenediamine, isophorone diamine, bis(4-amino-3-methylcyclohexyl)methane, diaminodicyclohexylmethane, m-xylenediamine, diaminodiphenylmethane, diaminodiphenylsulfone, diethyltoluenediamine, polyoxypropylene diamine, and m-phenylenediamine; guanidines, such as dicyandiamide, methylguanidine, ethylguanidine, propylguanidine, butylguanidine, dimethylguanidine, trimethylguanidine, phenylguanidine, diphenylguanidine, and toluylguanidine; acid hydrazides, such as succinic acid dihydrazide, adipic acid dihydrazide, phthalic acid dihydrazide, isophthalic acid dihydrazide, terephthalic acid dihydrazide, p-hydroxybenzoic acid hydrazide, salicylic acid hydrazide, phenylaminopropionic acid hydrazide, and maleic acid dihydrazide.

Low molecular weight compounds having a secondary amino group include, but are not limited to, piperidine, pyrrolidine, diphenylamine, 2-methylimidazole, and 2-ethyl-4-methylimidazole.

Low molecular weight compounds having a tertiary amino group include, but are not limited to, imidazoles, such as 1-cyanoethyl-2-undecylimidazole-trimellitate, imidazolylsuccinic acid, 2-methylimidazole-succinic acid, 2-ethylimidazole-succinic acid, 1-cyanoethyl-2-methylimidazole, 1-cyanoethyl-2-undecylimidazole, and 1-cyanoethyl-2-phenylimidazole.

Embodiments of the present disclosure may provide at least one of the following advantages. The disclosed downhole device may help address and control downhole issues that are difficult to deal with from the surface of the earth. In one or more embodiments, downhole issues may be addressed using the disclosed fluid containing downhole chemicals and the downhole device used to controllably release the downhole chemicals. Various downhole issues may be treated by selecting appropriate chemical substances in the fluid.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

When the word "approximately" or "about" are used, this term may mean that there can be a variance in value of up to ±10%, of up to 5%, of up to 2%, of up to 1%, of up to 0.5%, of up to 0.1%, or up to 0.01%.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

Thus, particular implementations of the subject matter have been described. Other implementations are within the scope of the following claims Although only a few example embodiments have been described in detail, those skilled in the art will readily appreciate that many modifications are possible in the example embodiments without materially departing from the scope of the disclosure. Accordingly, all such modifications are intended to be included within the scope of this disclosure as defined in the following claims. In the claims, means-plus-function clauses are intended to cover the structures described as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

It is noted that one or more of the following claims utilize the term "where" or "in which" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising." For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open-ended phrase to introduce a recitation of a series of elements, components, materials, or steps should be interpreted to also disclose recitation of the series of elements, components, materials, or steps using the closed terms "consisting of" and "consisting essentially of" For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of" The words "comprise," "has," and "include" and all grammatical variations thereof are each intended to have an open, non-limiting meaning that does not exclude additional elements or steps.

What is claimed is:

1. A downhole device that drills a wellbore comprising:

a stabilizer comprising:

a body; and blades disposed on a surface of the body and each comprising a hollow space, wherein the blades each comprise:

a dissolvable window disposed on a surface of each of the blades; and a light source disposed in the hollow space of each of the blades and configured to emit light to the wellbore, wherein the dissolvable window is configured to block the light emitted from the light source thereby reducing or eliminating light from being transmitted to the wellbore, and wherein the dissolvable window is configured to dissolve upon exposure to a fluid containing a dissolving medium, thereby allowing the light source to transmit the light to the wellbore.

2. The downhole device according to claim 1, wherein the dissolvable window comprises a dissolvable metal or a dissolvable polymer.

3. The downhole device according to claim 2, wherein the dissolvable polymer is polyglycolic acid or polylactic acid.

4. The downhole device according to claim 2, wherein the dissolvable metal is a magnesium-based alloy or an aluminum-based alloy.

5. The downhole device according to claim 1, wherein the dissolving medium is selected from the group consisting of brine, acid, water, and combinations thereof.

6. The downhole device according to claim 1, wherein the light source is an ultraviolet light source.

7. The downhole device according to claim 6, wherein the ultraviolet light source is configured to emit at least 2 different wavelengths of light.

8. A method for activating downhole chemicals, the method comprising:

providing a stabilizer that comprises;

a body; and blades disposed on a surface of the body and each comprise a hollow space, wherein the blades each comprise:

a dissolvable window disposed on a surface of each of the blades; and a light source disposed in the hollow space of each of the blades and configured to emit light to the wellbore, introducing a fluid comprising a dissolving medium and photosensitive capsules into the wellbore such that the dissolving medium contacts the dissolvable window;

dissolving the dissolvable window thereby exposing the wellbore to the light source;

exposing photosensitive capsules to the light emitted from the light source; and degrading the photosensitive capsules by irradiation of the light.

9. The method according to claim 8, wherein the photosensitive capsules comprise super absorbent polymers, or crosslinkers.

10. The method according to claim 8, further comprising, after degrading the photosensitive capsules, releasing super absorbent polymers or crosslinkers into the fluid.

11. The method of claim 10, wherein the fluid further comprises a reactant selected from the group consisting of a polymer, water, resins or crosslinkers.

12. The method of claim 11 further comprising, reacting the super absorbent polymers or crosslinkers with the reactant.

* * * * *